United States Patent [19]

Auborn et al.

[11] 4,049,024

[45] Sept. 20, 1977

[54] MANDREL AND METHOD OF MANUFACTURING SAME

[75] Inventors: James J. Auborn, Groton; Elizabeth Ann Trickett, Acton, both of Mass.

[73] Assignee: GTE Laboratories Incorporated, Waltham, Mass.

[21] Appl. No.: 693,022

[22] Filed: June 4, 1976

[51] Int. Cl.[2] ..... B21F 3/04

[52] U.S. Cl. ..... 140/71.5; 204/44

[58] Field of Search ..... 204/44; 140/71.5

[56] References Cited

U.S. PATENT DOCUMENTS

| | | | |
|---|---|---|---|
| 2,145,241 | 1/1939 | Armstrong et al. | 204/44 |
| 2,145,745 | 1/1939 | Armstrong et al. | 204/44 |
| 3,662,789 | 5/1972 | Koo et al. | 140/71.5 |

*Primary Examiner*—Lowell A. Larson

*Attorney, Agent, or Firm*—Irving M. Kriegsman

[57] ABSTRACT

A mandrel and a method for its manufacture and its use in manufacturing filament coils for electric lamps is disclosed. The mandrel, having a base core containing iron, is protected from diffusion of iron into a filament wire wound thereabout by a first coating of copper and a second coating of tungsten over the first, base metal. The process of coating the tungsten over the copper coating is improved by employing small amounts of copper ion contaminant in the electroplating solution. After a filament wire is wound around and annealed over this mandrel, the mandrel is selectively dissolved leaving the shaped filament coil, substantially free of extraneous metal impurities.

15 Claims, No Drawings

MANDREL AND METHOD OF MANUFACTURING SAME

BACKGROUND OF THE INVENTION

Filaments incandescent lamps are commonly manufactured in the form of coils (or coiled coils) by winding the filament wire in a coil around a metallic mandrel, annealing the coil, and selectively dissolving the mandrel from the coil with a suitable acid. In order to produce high quality filaments, care must be taken to avoid embrittlement of the filament wire, commonly tungsten, by diffusion of extraneous metal, such as iron, from the mandrel into the filament, typically during the procedure in which the filament is annealed.

Probably the most commonly employed material for mandrels is steel; however, substantial amounts of iron often diffuse into the filament wire during the manufacture and seriously impair its useful quality. Efforts have been made to avoid this diffusion by coating the steel with a non-alloying metal which impairs the diffusion of iron into the filament wire. U.S. Pat. No. 3,662,789 discloses the use of copper as such a coating. Similarly, tungsten may be employed as such a coating.

SUMMARY OF THE INVENTION

The present invention utilizes a double barrier to inhibit iron diffusion from the base mandrel by providing a thin coating of tungsten over a first coating of copper metal over the base steel mandrel. The non-alloying characteristics of the copper and tungsten serve to inhibit iron diffusion to a great degree.

In accordance with the present invention, tungsten is directly electro-deposited onto a copper substrate metal, from a tungsten electrodeposition solution containing small, contaminant amounts of copper ion.

The present invention is further directed to the process of manufacturing filament coils, which are particularly useful in the manufacture of incandescent lamps, using the mandrels made as described herein.

DETAILED DESCRIPTION OF INVENTION

The electrodeposition may be conducted utilizing any tungsten electroplating solution. Known tungsten solutions, suitable herein, include alkaline or ammonium tungstates, tungstic acid or tungstic oxides in alkaline solutions. The alkalinity may be provided by use of alkali metal alkaline earth metal salts and the tungstate salt in solution is directly identified by the alkaline agent used. Preferred are aqueous solutions of tungsten trioxide (from any soluble tungsten species). These solutions may also preferably contain alkali carbonate, and optionally trisodium phosphate. In general, the tungsten electroplating solution can be selected from those commonly employed in the art.

The amount of copper ion present, whether as cuprous (+1) or cupric (+2) ion, is not critical; however, small or contaminant amounts ranging generally from 0.1g/1 to about 0.3g/1 are suitable. The copper ion can be introduced into the electrodeposition solution by any convenient method including the addition of small amounts of a soluble copper salt, such as copper sulfate. One convenient, presently preferred method of providing the copper ion contaminant is by reversing the polarity on the plating cell having a copper or copper coated substrate for a short time before the deposition of tungsten is allowed to proceed.

Tungsten-containing electroplating solutions may have concentrations of from about 0.5M to about 0.6M of the tungsten species. A concentration of about 0.54M is presently preferred.

The current densities range from about 0.025 to about 0.25A/cm$^2$; a current density of from about 0.05 to about 0.5A/cm$^2$ is presently preferred.

The deposition of tungsten takes place in a short amount of time with suitable and effective coatings resulting in from about 3 to about 6 minutes of deposition time on a wire substrate. In the case of substrates having a greater diameter or surface area e.g. tabs of 1 to 10 cm$^2$ or more, deposition times are generally longer, upwards of 120 minutes.

The deposition takes place on the copper substrate cathodes. The use of platinum anodes is preferred although ferrous metal-containing anodes may also be used.

It is presently preferred to accompany the electrodeposition with vigorous gas evolution at both electrodes to insure a metallic deposit. Gas evolution is insured by use of usual techniques, such as employing a potential high enough to decompose water, i.e. in excess of 1.23V.

Best deposits are obtained by conducting the tungsten electrodeposition at elevated temperatures, i.e. utilizing solutions at a temperature of from about 85° to about 105° C and preferably at the boiling point (~100° C) of the aqueous electrodeposition solution.

The solution is preferably kept alkaline, but even in alkaline solution, it is possible to develop an acidic environment around the electrodes ($H_2$ dissolved) and this develops blue tungstates rather than metallic tungsten. Alkalinity is insured by use of alkaline additives of the type noted above.

As tungsten dissolves in alkaline solutions, the electrodes are electrolyzed while placed in and while being removed from the bath. The tungsten plating on the copper substrate replicates the surface of the substrate, and therefore, preparation of the surface of the substrate, as by electropolishing techniques, is desirable but not essential.

In general, the preferred conditions will electrodeposit useful, extremely thin (about 0.1 to about 1 μm) coatings of metallic tungsten, These coatings are generally bright, silvercolored and adherent and do not crack when the base substrate is bent.

The thus coated mandrel is particularly suitable for preparing useful filaments for incandescent lamps. In the manufacture of such filaments, a coil of filament wire, typically tungsten, is wound on the tungsten (and copper) coated mandrel of the present invention in a desired configuration and number of turns per unit length. The thus coiled mandrel is then annealed at about 1000° to about 1400° C, preferably about 1100° C or so, in a non-oxidizing atmosphere. This process sets the filament wire into the predetermined configuration as per the winding. After the annealing process, and subsequent cooling, the mandrel with filament is sized by cutting to desired lengths. Following the sizing procedure, the tungsten coated mandrel is selectively dissolved away from the filament, preferably using an inorganic acid, e.g. 25 to 35% nitric acid or hydrochloric acid. The filament is then ready for customary fabrication of incandescent lamps.

The following examples serve to further illustrate the present invention and set forth the presently preferred embodiments for the practice thereof. As such, however, they are not to be considered as limitations upon the overall scope hereof.

EXAMPLE A

A copper wire was electropolished in a solution containing 250 mls. of phosphoric acid, 250 mls. of ethanol, 50 mls. of propanol and 500 mls. of distilled water at 0.8 amps/cm² for 5 minutes. The resulting surface was smooth and ideal for subsequent tungsten deposition. Tungsten trioxide (125 g/l.) was added to a boiling aqueous solution containing 400 gms/l of sodium carbonate and the resultant solution was stirred until dissolution. The prepared copper wire was connected to a D. C. power supply and plated in the 100° C sodium carbonate/tungsten trioxide solution at 0.3A/cm² for 15 minutes employing a platinum mesh anode encircling the wire. This procedure produced a thin shiny metallic coating on the copper.

The following examples illustrate the improved results obtained by use of small amounts of copper ion in the electrodeposition solution.

EXAMPLE 1

A copper wire is electropolished as described in Example A and is then placed in an aqueous solution containing 125 g/l. of tungsten trioxide and 400 g/l. of sodium carbonate. The aqueous solution was maintained at about 100° C and the copper wire is then anodically electroplated with an encircling platinum mesh cathode for 3 minutes at 0.3 A/cm². Copper is thus deposited in the solution giving it a slightly blue cast. The polarity is then reversed and the copper wire is cathodically plated at 0.3 A/cm² for 3 minutes.

The resultant tungsten plate on the copper wire is adherant and shiny, comparable to the coating obtained as described in Example A which required 15 minutes.

EXAMPLES 2 - 7

The procedures of Example 1 are repeated, as modified according to the conditions, and with the results as set forth in the following Table:

TABLE

| EX. | COPPER SUBSTRATE | TUNGSTEN SPECIES CONC. (g./l.) | ALKALINE SPECIES CONC. (g./l.) | COPPER ION CONC. (g./l.) | CURRENT DENSITY, A/cm² | TIME, MIN. | DESCRIPTION OF DEPOSIT |
|---|---|---|---|---|---|---|---|
| 2 | copper coated steel mandrel wire | $WO_3$; 125 | $Na_3PO_4$; 500 | 0.1 | 0.3 | 3 | shiny, metallic |
| 3 | copper coated steel mandrel wire | $WO_3$; 125 | $Na_2CO_3$; 400 | 0.1 | 0.3 | 3 | very shiny, metallic |
| 4 | copper wire | $WO_3$; 125 | $Na_2CO_3$; 200 | 0.2 | 0.04 | 3 | shiny, black |
| 5 | copper tab | $WO_3$; 125 | $Na_2CO_3$; 100 | 0.1 | 0.26 | 120 | very shiny, silver metallic plate |
| 6 | copper tab | $WO_3$; 125 | $Na_2CO_3$; 100 | 0.3 | 0.3 | 25 | metallic blue plate |
| 7 | copper tab | $WO_3$; 125 | $Na_2CO_3$; 200 | 0.1 | 0.5 | 2 | shiny "white" silver plate |

EXAMPLE 8

A tungsten filament wire is wound about the mandrel of Example 1, annealed in a nitrogen atmosphere at 1100° C for 10 minutes, then, after cooling, the mandrel is dissolved away with 30% nitric acid.

We claim:

1. A process which comprises directly electrodepositing tungsten onto a copper substrate metal, from a tungsten electrodeposition solution contaminated with from about 0.1 to about 0.3 gms/l of copper ion.

2. The process of claim 1 wherein the copper substrate metal contains iron.

3. The process of claim 1 wherein the copper substrate metal is copper coated steel.

4. The process of claim 1 wherein the solution is an aqueous alkaline solution.

5. The process of claim 4 wherein the tungsten electrodeposition solution is aqueous tungsten trioxide.

6. The process of claim 5 wherein the concentration of copper ion is from about 0.1 to about 0.3 gms/l.

7. The process of claim 6 wherein the copper substrate is copper coated steel.

8. The process of claim 1 wherein the copper ion is provided by reversing the polarity prior to electrodeposition of tungsten.

9. The process of claim 1 conducted at from about 85° C to about 105° C.

10. The process of claim 1 where said tungsten solution contains about 0.5 M to about 0.6 M of the tungsten species.

11. The process of claim 1 where the tungsten is electrodeposited from solution at a current density of about 0.025 to about 0.75 A/cm².

12. The process of claim 1 where said electrodeposition is conducted at a sufficiently high electrical potential to cause evolution of gas at the electrodes.

13. A process for making mandrels useful for making filaments for incandescent lamps comprising the step of directly electrodepositing tungsten onto a copper substrate metal from a tungsten electrodeposition solution contaminated with from about 0.1 to about 0.3 gms/l of copper ion.

14. A process of making incandescent lamp filaments comprising the steps of directly electroplating a tungsten electrodeposition solution contaminated with from about 0.1 to about 0.3 gms/1 of copper ion, winding filament wire around the tungsten coating, annealing the filament wire winding, and selectively dissolving the tungsten coated copper substrate metal from the filament wire.

15. The process of claim 14 wherein the copper substrate metal is copper coated steel.

* * * * *